United States Patent [19]

Iijima et al.

[11] Patent Number: 4,623,243

[45] Date of Patent: Nov. 18, 1986

[54] APPARATUS FOR IMPROVING THE PERFORMANCE OF NON-CRYSTALLINE SILICON PHOTOSENSITIVE MATERIAL IN AN ELECTRONIC COPIER

[75] Inventors: Toshiyuki Iijima; Hedeki Kina; Masaharu Nanba, all of Kanagawa, Japan

[73] Assignees: Fuji Electric Co., Ltd., Kawasaki; Fuji Electric Corporate Research & Development Limited, Yokosuka, both of Japan

[21] Appl. No.: 494,268

[22] Filed: May 13, 1983

[30] Foreign Application Priority Data

May 18, 1982 [JP] Japan ..... 57-83623

[51] Int. Cl.[4] ..... G03G 21/00

[52] U.S. Cl. ..... 355/15

[58] Field of Search ..... 355/3 CH, 14 CH, 15

[56] References Cited

U.S. PATENT DOCUMENTS 2,965,756 12/1960 Vyverberg ..... 250/324

OTHER PUBLICATIONS

Schaffert, "Electrophotography", 1975, pp. 67–68, Focal Press Limited.

*Primary Examiner*—A. T. Grimley
*Assistant Examiner*—David Warren
*Attorney, Agent, or Firm*—Finnegan, Henderson, Farabow, Garrett & Dunner

[57] ABSTRACT

An apparatus for forming images on a photosensitive material of non-crystalline silicon where the deterioration of image quality from charge storage effects is reduced by charging the photosensitive material at a polarity opposite that of its initial charging prior to the image forming irradiation of photosensitive material.

12 Claims, 6 Drawing Figures

FATIGUE EFFECTS OF NEGATIVE AND LIGHT ANTISTATIC

APPARATUS FOR IMPROVING THE PERFORMANCE OF NON-CRYSTALLINE SILICON PHOTOSENSITIVE MATERIAL IN AN ELECTRONIC COPIER

BACKGROUND OF THE INVENTION

This invention relates to an electronograph provided with a photosensor formed with non-crystalline silicon (a-Si:H) as a photoconductive material.

Known photoconductive materials used as photosensors for electronographs include selenium tellurium alloys, selenium arsenic alloys and the like made mainly by mixing together semiconductors such as zinc oxide (ZrO), cadmium sulphide (CdS), polyvinylcarbazol (PVK) and amorphous selenium (a-Se) and amorphous silicon (a-Si). Although each of these materials for use in photosensors has its own advantages, it has not always fully satisfied the performance requirements of the photosensor. Particularly with the recent appearance of high-speed copying machines or printers, demand for photosensors with excellent abrasion resistance is increasing.

A photosensor a-Si:H meets such requirements because of its superior mechanical properties and abrasion resistance. In addition, it has excellent heat resistance because its crystallization temperature is higher than that of a-Se. Furthermore, the use of a-Si:H produces less environmental pollution. Because of these benefits of a-Si:H, there has been intense development of this material for utilization in photosensitive layers for electronographs.

However, it has been discovered by the present inventors and others that the charge-storage capacity of a photosensitive layer containing a-Si:H varies to a large extent with the type of radiation that is used. Layer fatigue is increased by repeated irradiation and this deteriorates the charge-storage capacity of such a layer and reduces its image quality. This layer fatigue results from the fact that some of the charge carriers produced by the irradiation remain in the photosensitive layer. In other words, rays of light incident to the surface of a photosensitive layer, excluding those reflected, penetrate into and are absorbed by the layer. Some of the carriers generated by the light are extinguished through recombination and some are trapped by defects in the layer and stay in the photosensitive layer. This reduces the electric potential in the layer because the release of the trapped carriers is accelerated when an electric field is applied during the subsequent charging process. The trapped carriers during this time are not locked in the carrier traps, but are released because of thermal excitation so that the number of trapped carriers decreases. Accordingly, the reduction of the electric potential resulting from irradiation depends upon the length of time after the irradiation, particularly after the application of discharging rays of light which are stronger than the image exposure. Thus, the reduction of the potential is theoretically decreased further if the length of time between the irradiations is increased.

It is, however, not practical to utilize a copying process that requires a significant time between the initial irradiation and the operation of the charging device.

An object of the present invention is to provide an electronograph with an a-Si:H photosensitive layer that is resistant to fatigue caused by light using means readily applicable to a commercially practical apparatus.

Other objects of the invention will become apparent from the description of the preferred embodiment or may be learned by practice of the disclosed invention.

SUMMARY OF THE INVENTION

The above-noted objects of the present invention can be achieved by providing an apparatus for forming a latent image on a photosensitive layer that utilizes a corona charge erasing means having a charge opposite that of the initial charge given the surface of the photosensitive layer to eliminate what has been termed fatigue of the photosensitive material.

The present invention is an apparatus for forming latent images on a photosensitive layer and includes a photosensitive material of non-crystalline silicon. A first charging device places a residual electric charge on the photosensitive material. An image-forming means, which includes a light source, irradiates the charged photosensitive layer to produce a latent image on the surface of the material. The apparatus further includes light charge erasing means and corona charge erasing means for inducing an electric charge on the photosensitive material with the polarity of the electric charge induced by the corona charge erasing means being opposite that of the charge on the photosensitive material induced by the first charging device. Preferably, the photosensitive material is disposed on a drum-like member with the first charging device, the light source, the light charge erasing means and the corona charge erasing means being placed radially around the drum-like member in that order with respect to the direction of rotation of the drum-like member.

DESCRIPTION OF THE PREFERRED EMBODIMENT

Figure 1:
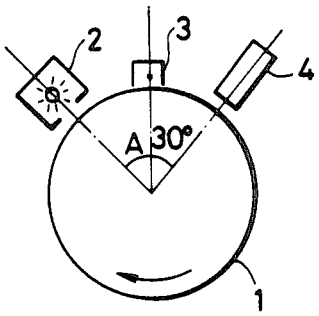
FIG. 1 is a schematic representation of a testing apparatus used to determine the fatigue of a drum-like photosensor.
Figure 4:
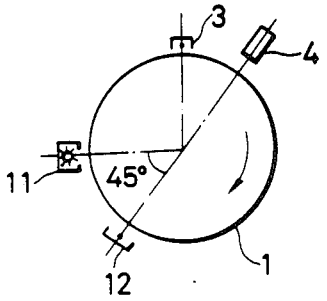
FIG. 4 is a schematic representation of a testing apparatus used to determine the effects of the present invention.
Figure 5:
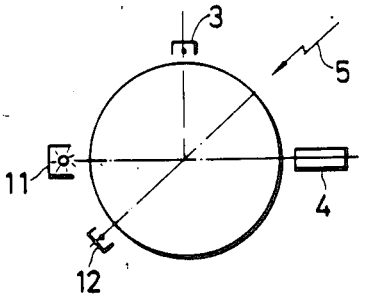
FIG. 5 is a schematic representation of another testing apparatus.
Figure 6:
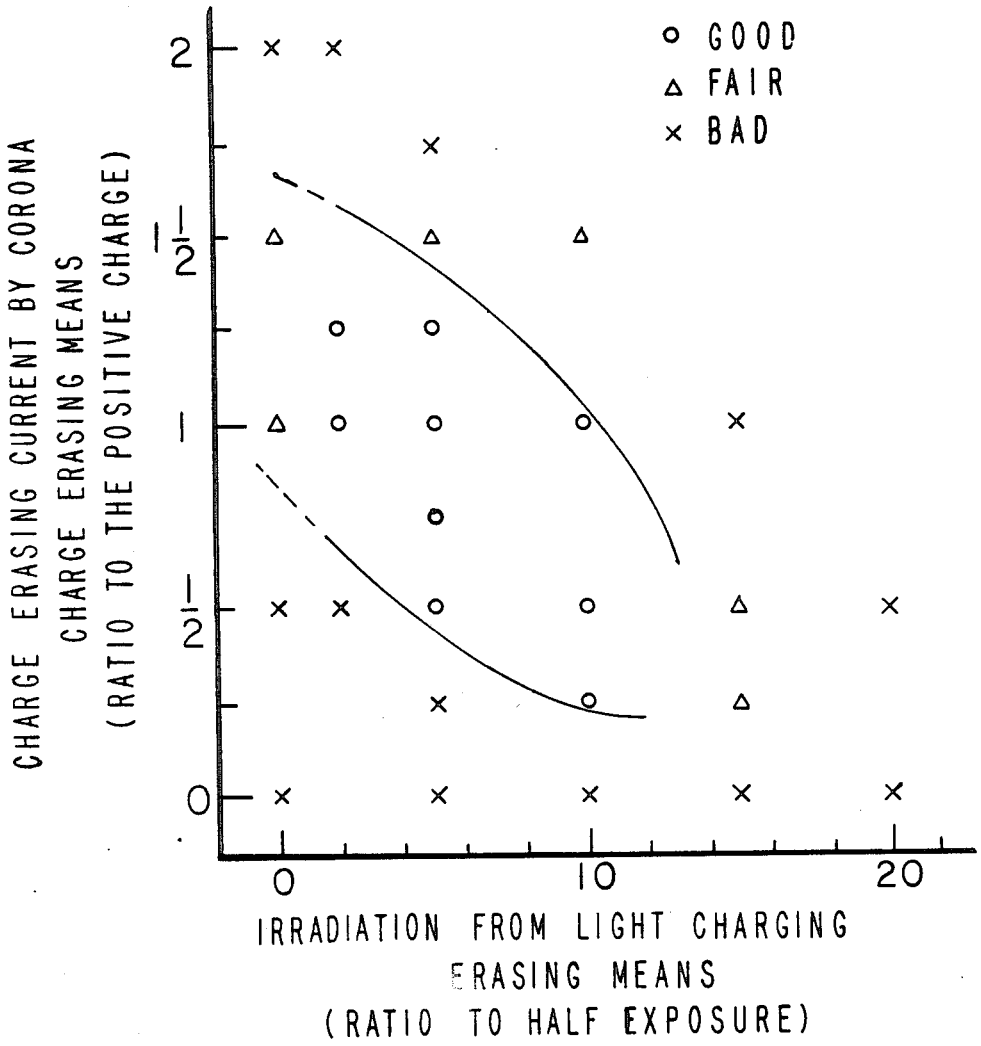
FIG. 6 is a graph showing the effect of the intensity of irradiation from the light charge erasing means and the negative antistatic potentials provided by the corona charge erasing means.

The problems addressed by the present invention were investigated and confirmed by the apparatus depicted in FIGS. 1, 4 and 5.

FIG. 1 is a testing apparatus for determining the effect of radiation fatigue on photosensitive material. The apparatus has an antistatic light source 2, a charging device 3 and a probe 4 for measuring surface electric potential of the layer. These components are arranged in order around a rotatable photosensor 1 having a non-crystalline a-Si:H photosensitive layer. The electric potential of the layer is measured by the probe 4 after the layer is charged by the charging device 3 and compared to the value when the layer also receives light from the antistatic light source 2. Subsequently, the dependence of the reduction of the layers' electric potential on the time elapsed between irradiation and charging was evaluated by changing the relative position of the antistatic light. The potential when the antistatic light was not irradiated was 450 V.

Figure 2:
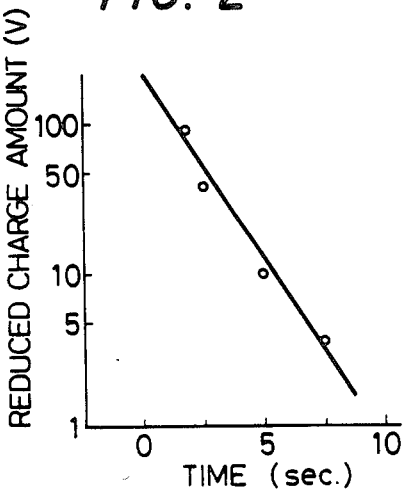
FIG. 2 is a graph illustrating the relation between the reduced charge amount obtained by the apparatus shown in FIG. 1 and the time elapsed after antistatic light irradiation.

FIG. 2 illustrates the dependence of the surface potential on the time elapsed after irradiation. The longer the time elapsed, the less the fatigue: The reduced amount of the potential is recognized to be sufficiently small after three seconds or more, particularly five seconds or more. However, it is impractical to use such a delay time between irradiation and the operation of the charging device in a commercially viable process.

Figure 3:
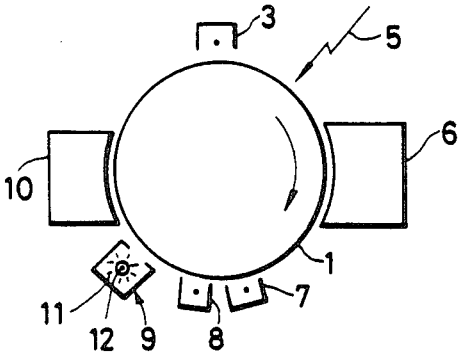
FIG. 3 is a schematic representation of a preferred embodiment of the present invention.

The present invention will be described by reference to the preferred embodiment of FIG. 3 as follows: The electronograph of FIG. 3 includes a charging device 3, an image exposure system 5, a development processor 6, a transcriber 7, a paper separator 8, and antistatic device 9 and a cleaner 10 are arranged in order around a drum-like photosensor 1 having an a-Si:H photosensitive layer. In such an apparatus, images are repeatedly formed by the rotation of the photosensor 1.

The charging device 3 is used to give an electric charge to the surface of the photosensitive layer of the photosensor 1, and a corona discharge device is ordinarily employed. As a light source for use in the image exposure system 5, the following source commonly known may be used: a white light source such as a tungsten filament or halogen filament lamp; a fluorescent lamp or a He-Ne laser or semiconductor laser light source; or a light emitting diode or the like. For the processor 6, either one or two component type development methods are applicable with respect to the paper separator 8, not only an a.c. discharge device illustrated but also a claw separator may be used. In addition, a blade cleaner, a fur brush or the like may be used as the cleaner mechanism 10. Instead of providing a separate cleaner, known cleaning methods employing a processor are also applicable.

According to present invention, the purpose of installing antistatic device 9 is to remove static charges that remain on the surface of the photosensor. The antistatic device 9 includes light charge erasing means 11, in combination with a corona charge erasing device 12. The corona charge erasing device 12 supplies the photosensitive drum with a charge that is opposite in polarity from the electric charge generated by charging device 3. It should be noted, however, that it is not necessary to integrally combine the light charge erasing means 11 and the corona charge erasing device 12. Rather, the devices may be separately stationed between the paper separate 8 and the cleaner 10. The light charge erasings means may be any white light source, including, inter alia, a tungsten filament, a halogen filament lamp, a flourescent lamp, an electroluminescent lamp, or any similar white light source. It has also been discovered, that fatigue of the photosensitive materials can be further reduced by controlling the wavelength of the light that is emitted from light charge erasing means 11. When a white light source is used as the light charge erasing means, and optical filter may be utilized to control the wavelength of light that impinges the photosensitive layer.

FIG. 4 illustrates a testing apparatus for confirming the effects of the present invention. A positively charging device 3, a negative corona charge erasing means 12 and light charge erasing means 11 were arranged around an a-Si:H photosensor 1. The degree of fatigue by light was measured in terms of the surface potential by means of the placement of a probe 4 for measuring electric potential. A white light source with a color temperature of 2,900° K. was used as the a light charge erasing means 11. The amount of irradiation was set at 10 times as large as the half damping exposure (the light amount that can reduce the surface potential of the photosensitive layer by half), and the photosensor 1 was turned at 19 r.p.m.

Table 1 indicates the test results in which the magnitude of antistatic light charge produced by the negative corona charge erasing device 12 is shown by the ratio of current made to flow into the photosensor on the drum by the positive charging device 3 to the drum current when using negative antistatic drum charging. The variation of electric potential is displayed as the difference between the initial potential of 400 V and the potential after 200 repetitions.

TABLE 1

| negative antistatic: | 0 | ¼ | ½ | 1 | 3/2 |
|---|---|---|---|---|---|
| variation of potential: | −80 | −20 | −15 | −40 | −55 |

As shown in the Table, by biasing the corona charge erasing device 12 negatively, fatigue by light has been reduced in comparison with the case in which only the light antistatic process is employed.

FIG. 5 illustrates a testing apparatus which is similar to an electronograph in actual use. In FIG. 5, an light source 5 (located at an angle of 45° to a positively charging device 3) and a probe 4 (located at an angle of 90° to the device) are shown together with a negative corona charge erasing device 12 and light charge erasing means 11 arranged in the same way as those shown in FIG. 4.

This apparatus was used to measure the surface potential on the drum photosensor by repeating irradiation from the light source 5 between on and off states at 25 cycles. The change of the surface potential by the repetition reached 135 V when the antistatic process only was carried out in the case of measurement on the off state of irradiation. By contrast, the surface potential could be reduced to less than 40 V when the negative antistatic process was added at the current ratio (as described above, in connection with Table 1) of 1 or less. On the other hand, when the negative antistatic process was employed, the change became large for several cycles after the irradiation was turned off from on and on from off, and this proved impractical for use. In addition, if light with wavelength shorter than 600 nm is used as the light charge erasing means, the variation of electric potential may be reduced to substantially zero.

As mentioned above, the principal object of the present invention is to reduce the fatigue caused by light which is the disadvantage of an a-Si:H photosensor otherwise having excellent abrasion and heat resistance. This improvement results from combining a corona charge erasing device that is opposite in polarity to that of the photosensor with antistatic light. The invention is readily applicable to an actual electronograph and has the effect on putting the a-Si:H photosensor material to practical use.

What is claimed is:

1. An apparatus for forming latent images on a photosensitive layer, said apparatus comprising:

(a) a photosensitive material of non-crystalline silicon;

(b) a first charging device for placing a residual electric charge on said material;

(c) image forming means including a first light source for irradiating the charged photosensiive layer to produce a latent image on the surface of said material;

(d) light charge erasing means for optically removing the residual charges remaining on said photosensitive material; and (e) corona charge erasing means for electrically removing the residual charges remaining on said photosensitive material, the intensity of the charge erasing current produced by said corona charge erasing means being selected from the range of negative one quarter ($\frac{1}{4}$) to negative five-fourths (5/4) of the intensity of the charging current produced by said first charging device.

2. The apparatus of claim 1 wherein said light charge erasing means comprises a second source of light disposed to irradiate said photosensitive material, said irradiation having a wavelength of 600 nm or less.

3. The apparatus of claim 1 wherein said light charge erasing means is a second light source in combination with an optical filter.

4. The apparatus of claim 1 wherein said apparatus includes means for cleaning the surface of said photosensitive material and said corona charge erasing means induces an electric charge on said photosensitive material prior to said material being exposed to said cleaning means.

5. The apparatus of claim 1 wherein said photosensitive material is disposed on a drum-like member, with said first charging device, said light source, said light charge erasing means and said corona charge erasing means being placed radially in that order with respect to the direction of rotation of said drum.

6. The apparatus of claim 5 wherein said apparatus includes cleaning means adjacent said drum-like member, said cleaning means being located between said corona charge erasing means and said first charging device.

7. The apparatus of claim 1 wherein said corona charge erasing means comprises a d.c. corona.

8. The apparatus of claim 1 wherein said first charging device and said first light source leave a positive charge on said photosensitive material and said corona charge erasing means induces a negative charge.

9. An apparatus for electrically forming an image on paper or the like, said apparatus comprising:

(a) a drum-like member having an outer radial surface comprised of a photosensitive layer of non-crystalline silicon;

(b) a first charging device utilizing a d.c. corona to place a residual electric charge on said photosensitive material;

(c) image forming means including a first light source for irradiating the charged photosensitive layer of said drumlike member to produce a latent image thereon;

(d) developing means for applying developer to said latent image;

(e) means for transcribing said developer to paper applied to said drum-like member;

(f) paper removing means;

(g) light charge erasing means for optically removing the residual charges remaining on said photosensitive material; and (h) corona charge erasing means for electrically removing the residual charges remaining on said photosensitive material, the intensity of the charge erasing current produced by said corona charge erasing means being selected from the range of negative one quarter ($\frac{1}{4}$) to negative five-fourths (5/4) of the intensity of the charging current produced by said first charging device.

10. The apparatus of claim 9 including drum cleaning means, wherein elements (a), (b), (c), (d), (e) and (f) and said drum cleaning means are arranged radially, elements (a) through (f) being in order with respect to the direction of rotation with elements (g) and (h) being disposed between element (f) and said drum cleaning means.

11. The apparatus of claim 9 wherein said light charge erasing means emits light at a wavelength of 600 nm or less.

12. The apparatus of claim 9 wherein said light charge erasing means includes an optical filter and the incident light on said photosensitive material has a wavelength less than 600 nm.

* * * * *